United States Patent [19]

Weger, Jr.

[11] Patent Number: 5,076,078

[45] Date of Patent: Dec. 31, 1991

[54] LOCK SYSTEM

[75] Inventor: Kenneth F. Weger, Jr., Cary, Ill.

[73] Assignee: Knaack Manufacturing Company, Crystal Lake, Ill.

[21] Appl. No.: 649,229

[22] Filed: Jan. 28, 1991

Related U.S. Application Data

[63] Continuation of Ser. No. 365,661, Jun. 13, 1989, abandoned.

[51] Int. Cl.[5] ..... E05B 67/38

[52] U.S. Cl. ..... 70/54; 292/104; 292/205

[58] Field of Search ..... 70/54–56; 292/281, 205, 104, 148

[56] References Cited

U.S. PATENT DOCUMENTS

| | | | |
|---|---|---|---|
| 1,262,809 | 4/1918 | Kolody | 292/205 X |
| 1,592,405 | 7/1926 | Worley, Jr. et al. | 70/81 |
| 1,669,312 | 5/1928 | Sundquist | 292/281 |
| 2,461,708 | 2/1949 | Thein | 292/281 |
| 2,825,218 | 3/1958 | O'Brien . | |
| 3,112,839 | 12/1963 | Hallbauer . | |
| 3,156,282 | 11/1964 | Bedford, Jr. | 403/254 X |
| 3,572,062 | 3/1971 | Beebe | 70/1.5 |
| 3,590,607 | 7/1971 | Beaver | 70/56 |
| 3,652,114 | 3/1972 | Cady et al. | 292/281 |
| 3,851,942 | 12/1974 | Clay et al. | 312/333 |
| 4,106,315 | 8/1978 | Dohanyos | 70/56 |
| 4,165,944 | 8/1979 | Sunasky | 403/254 |
| 4,290,281 | 9/1981 | Knaack et al. | 70/54 |
| 4,581,907 | 4/1986 | Eberly | 70/54 |
| 4,781,043 | 11/1988 | Loeffler | 70/54 |

FOREIGN PATENT DOCUMENTS

| | | | |
|---|---|---|---|
| 240836 | 10/1962 | Australia . | |
| 64533 | 5/1946 | Denmark | 292/281 |
| 878907 | 7/1953 | Fed. Rep. of Germany | 292/104 |
| 7712422 | 11/1976 | Netherlands . | |
| 2058196 | 4/1981 | United Kingdom | 70/56 |
| 2185519 | 7/1987 | United Kingdom | 70/54 |

OTHER PUBLICATIONS

American Van Equipment, Catalog 41, Jun. 1990, pp. 1 and 22 (the "Tool Vault" lock system illustrated was offered for sale, advertised and used more than one year before the priority filing date of this application).

*Primary Examiner*—Lloyd A. Gall
*Attorney, Agent, or Firm*—Leydig, Voit & Mayer

[57] ABSTRACT

A padlock-protecting lock system for use with a container having a movable closure. A shelf supports the padlock within the container such that only the key insertion end of the padlock is exposed for external access and a bracket having one or more depending legs is carried, such as by an arrangement of corresponding prongs and slots, by the supporting shelf and captures the shackle of the padlock. A tang is associated with the movable closure and is positionable within the shackle for capture by the padlock upon locking thereof, whereby the closure is maintained in its closed position.

26 Claims, 5 Drawing Sheets

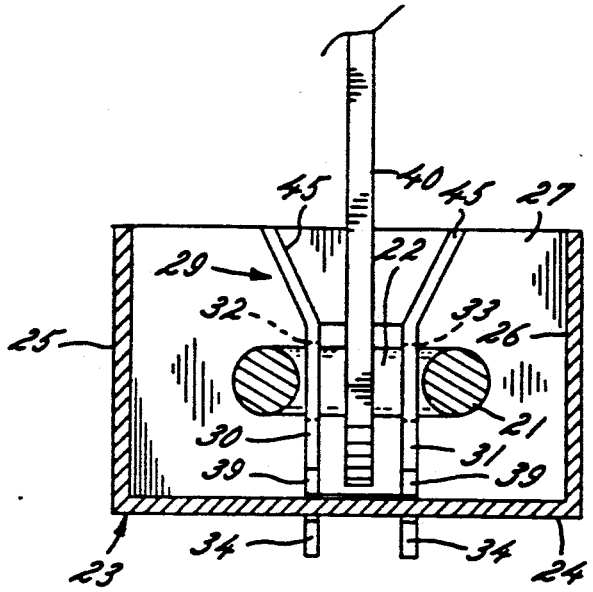
FIG. 5
FIG. 7
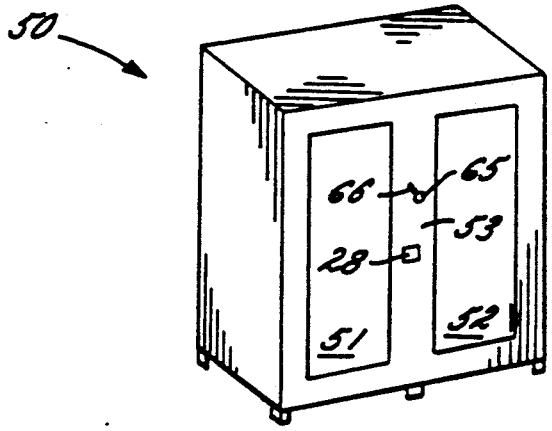
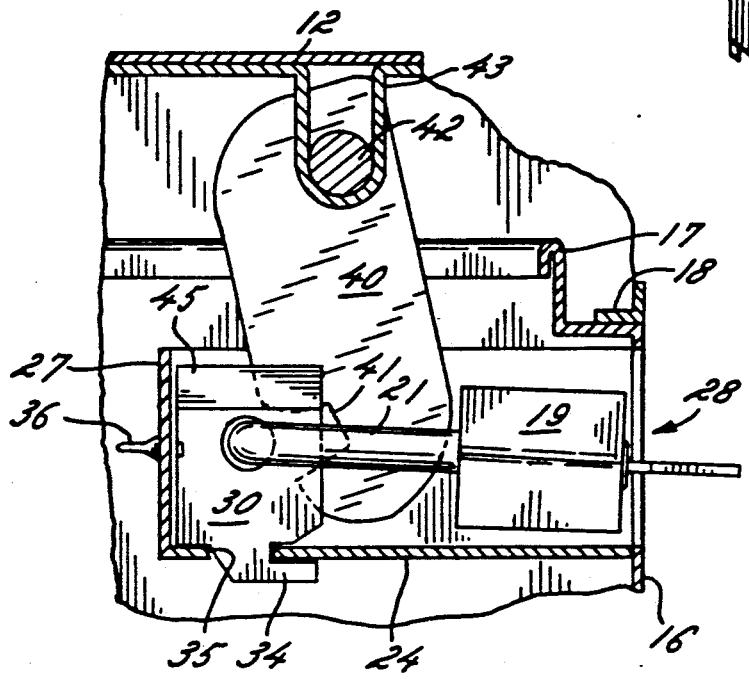
FIG. 6

LOCK SYSTEM

This is a continuation of copending application Ser. No 365,661, filed on June 13, 1989, now abandoned.

TECHNICAL FIELD

The present invention relates generally to a lock system for a container and, more particularly, to a lock system in which a padlock is located within the container so as to not be exposed to tampering.

BACKGROUND ART

Containers, such as tool boxes and storage cabinets, which are used at construction sites and similar locations for storage of tools and materials are typically padlocked. Due to the value of the tools and materials stored in such containers at these sites, it is additionally desirable in most instances to use containers having lock systems which shield the padlock from exposure to tampering, such as by attempts to cut the padlock shackle or pry the shackle from the padlock body.

Knaack et al. U.S. Pat. No. 4,290,281, which is owned by the assignee of this application, describes and claims a lock system in which a padlock is mounted within a container such that only its key insertion end is exposed for external access. While the embodiment of the lock system illustrated and described in the Knaack et al. patent is very effective to prevent padlock tampering, it is cumbersome and somewhat time consuming to install in the confined space of a tool container (preferably adjacent the flanged walls) since screws are needed to secure the shackle-engaging bracket. Moreover, since the illustrated bracket has only a single leg for engaging the padlock shackle, it is sometimes necessary to also use a stabilizing bracket to prevent lateral movement of the padlock, thus further complicating the installation procedure.

It will be appreciated from the foregoing that since the embodiment of the lock system described in the Knaack et al. patent is somewhat difficult to assemble and install, tool containers utilizing that system have somewhat higher manufacturing costs. Moreover, users of such tool containers face similar difficulties in the initial installation of the lock system and in disassembling/removing the lock system if, for example, replacement becomes necessary.

Accordingly, it is a primary object of the present invention to provide an improved padlock-protecting lock system which may be simply and quickly installed (or removed).

Another object of this invention is to provide such an improved padlock-protecting lock system which comprises a minimal number of parts.

A related object of this invention is to provide such an improved padlock-protecting lock system which is economical to both manufacture and install.

A further object of this invention is to provide such an improved padlock-protecting lock system which engages the shackle of the padlock in a manner which prevents substantial lateral movement of the padlock.

Other objects and advantages of the invention will be apparent from the following detailed description.

SUMMARY OF THE INVENTION

In accordance with the present invention, there is provided a padlock-protecting lock system for use with a container having a movable closure. A shelf supports the padlock within the container such that only the key insertion end of the padlock is exposed for external access and a bracket having one or more depending legs is carried, such as by an arrangement of corresponding prongs and slots, by the supporting shelf and captures the shackle of the padlock. A tang is associated with the movable closure and is positionable within the shackle for capture by the padlock upon locking thereof, whereby the closure is maintained in its closed position.

BRIEF DESCRIPTION OF THE DRAWINGS

FIG. 5 is a fragmentary section, taken generally along the line 5—5 in FIG. 4 and with the tool box omitted;

FIG. 6 is a view, similar to FIG. 4, showing the lock system unlocked;

FIG. 7 is a perspective view of a storage cabinet embodying the invention;

DESCRIPTION OF THE PREFERRED EMBODIMENTS

While the invention will be described in connection with certain preferred embodiments, it will be understood that it is not intended to limit the invention to these particular embodiments. On the contrary, it is intended to cover all alternatives, modifications and equivalents included within the spirit and scope of the invention as defined by the appended claims.

Turning now to the drawings and referring first to FIGS. 1—6, there is shown a first embodiment of the lock system in association with a tool box, generally indicated at 10. The tool box has a body 11 and a movable closure in the form of a cover 12 connected to the body by hinges 13 at the rear of the tool box.

Figure 2:
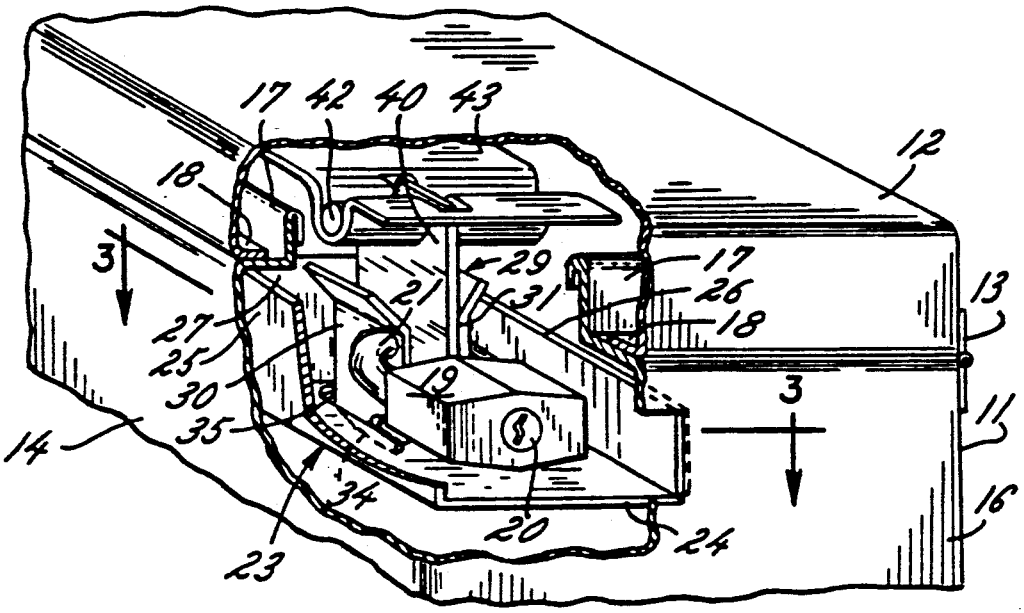
FIG. 2 is a fragmentary, perspective view on an enlarged scale of a corner of the locked tool box, with parts broken away.
Figure 3:
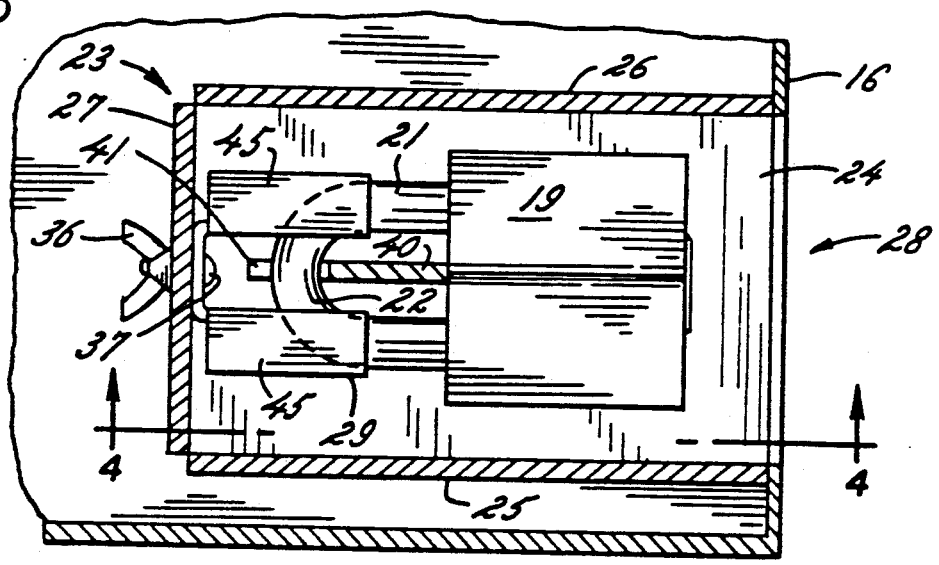
FIG. 3 is a plan section, taken generally along the line 3—3 in FIG. 2.

The tool box body 11 has front and rear walls 14, 15 and end walls 16 extending between the front and rear walls. As shown in FIG. 2 for the front wall 14 and an end wall 16, each of the walls has an inturned flange 17 at its upper edge. Similarly, the downturned perimeter of the cover 12 has an inturned flange 18 which rests on the inturned wall flanges 17 to form a secure closure for the tool box.

Figure 1:
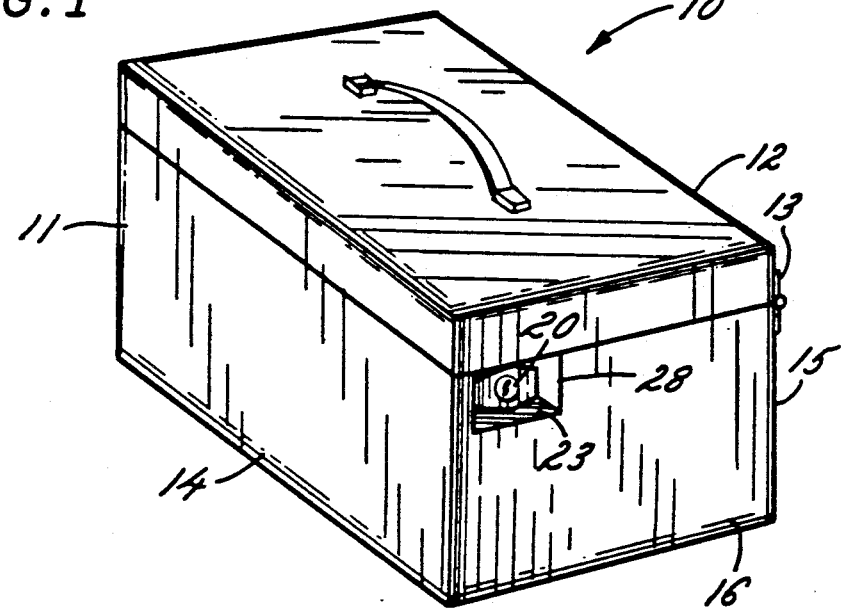
FIG. 1 is a perspective view of a container, such as a tool box, which is locked by the lock system.

The lock system of the present invention utilizes a padlock having a body 19 with a key insertion end 20 and a generally U-shaped shackle 21 with a pair of legs and an interconnecting bight 2. A substantially horizontally-oriented supporting shelf member 23—having a U-shaped channel cross section with a bottom 24, a pair of spaced-apart side walls 25, 26 and a transverse end wall 27—is permanently secured within the tool box by having edges of its bottom 24 and side walls 25, 26 welded to the interior of the end wall 16 of the tool box. As best seen in FIG. 1, the interior channel of the supporting shelf 23 communicates with the exterior of the tool box through an aperture 28 in the end wall 16 thereof. Accordingly, with the tool box closed and locked, only the key insertion end 20 of the padlock body is exposed. Therefore, tampering with the padlock—such as by attempts to cut the shackle or separate it from the padlock body—is effectively prevented.

It will be appreciated that the supporting shelf 23 may just as effectively be positioned to communicate with the exterior of the tool box through an aperture in the front wall 14. Moreover, for large tool chests, it may be desirable to utilize more than one of the inventive lock systems (e.g., positioned at substantially opposite ends of the container).

In accordance with an important aspect of an embodiment of the present invention, a bracket is removably connected to the supporting shelf by integral prong means and is configured so as to loosely capture the shackle of the padlock and thereby prevent substantial movement thereof. More specifically, a substantially U-shaped bracket 29 having a pair of spaced-apart depending legs 30, 31 is provided. The legs 30, 31 have respective coaxial bores 32, 33 therethrough, thereby providing means by which the bracket 29 can loosely capture the shackle 21 of the padlock.

It will be appreciated that the bracket's pair of legs, due to their spaced-apart orientation, will substantially prevent axial movement of the padlock shackle 21 with respect to the bores 32, 33 and, thus, limit lateral movement of the padlock body with respect to the aperture 28 in the container wall. Of course, this same effect can be achieved by utilizing a bracket (not shown) having a single, thick leg member with a bore therethrough for receiving the padlock shackle 21.

Figure 4:
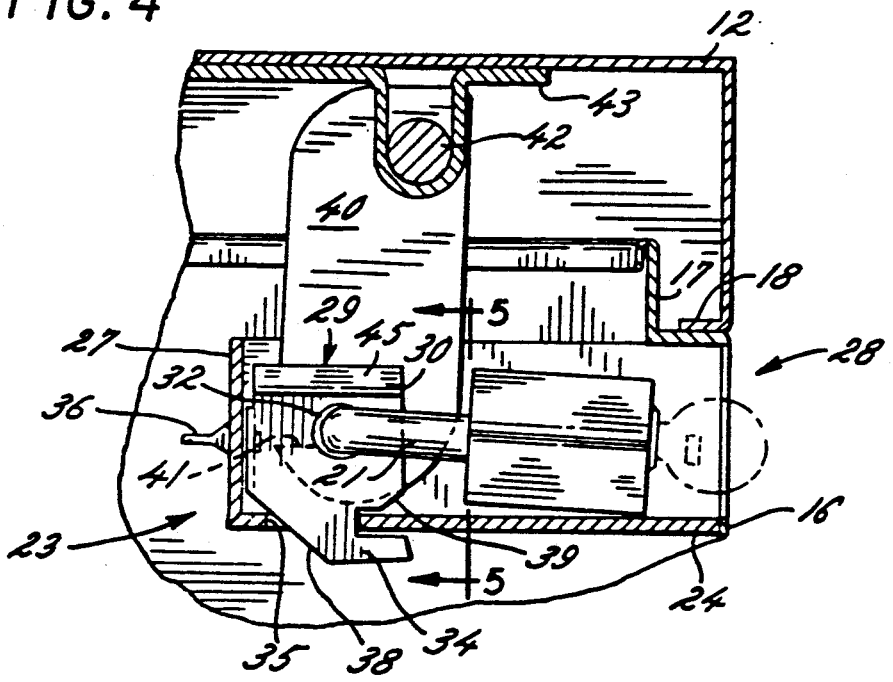
FIG. 4 is a vertical section, taken generally along the line 4—4 in FIG. 3.

The bracket 29 further comprises integral prong means by which it removably engages the supporting shelf 23. More specifically, one or more integral prongs 34 extend from the bracket 29 and are oriented so as to removably engage corresponding slots 35 formed or cut into the supporting shelf. As shown in the embodiment of FIGS. 4–6, a prong 34 extends from the bottom edge of each leg 30, 31 of the bracket 29 in spaced, substantially parallel relation to the legs. Prongs 34 engage corresponding slots 35 in the bottom 24 of the supporting shelf, and thereby extend beneath the bottom plate 24 and toward the end wall 16 of the container through which the aperture 28 is formed. It follows, of course, from this configuration and orientation of prongs 34 and slots 35, that the bracket 29 removably engages the supporting shelf 23, but while engaged is secured to the bottom of the support shelf such that forces exerted on the padlock will not free bracket 29 from the bottom of the support shelf. Of course, if desired, the bracket 29 may be more rigidly anchored to the supporting shelf 23, for example, by means of a nut and bolt arrangement 36, 37.

It should be noted that the rear edges of the prongs 34 and the front, lower edges of the bracket's legs 30, 31 have inclined portions (38 and 39, respectively). Inclined portions 38, 39 are designed to allow the bracket 29 to be maneuvered as the bracket engages the support member so that integral prongs 34 may be quickly and easily inserted into the corresponding slots 35 and into engagement with the bottom 24 of the supporting shelf. Thus, in addition to providing secure engagement between the bracket 29 and the supporting shelf 23, the prong/slot arrangement provides a quick and easy approach to assembling and/or disassembling the lock system. Bolts, rivets or other such anchoring devices, which complicate the assembly/disassembly routines, are not necessary.

A tang 40 is pivotally mounted on the underside of the cover 12, the tang consisting of a planar member having a locking notch 41 along an edge thereof for coaction (as shown particularly in FIGS. 2, 3 and 4) with the bight 22 of the padlock shackle. The tang 40 is mounted by means of a rod 42 which extends therethrough and which is rotatably mounted within a bracket 43 secured to the underside of the cover 12, as by welding. In order for the tang 40 to be normally urged to an inclined position relative to the cover 12 (as shown in FIG. 6), the opening in the tang which receives the rod 42 is offset from the center of gravity of the tang. Consequently, when the cover 12 of the tool box is closed and the padlock is unlocked, the tang 40 is positioned such that its lower end is loosely disposed within the legs of the shackle 21, with the locking notch 41 generally at the level of the shackle bight 22. This orientation of the tang 40 and the shackle 21 allows the tang and shackle to be engaged or disengaged, depending on whether the padlock is locked. Upon longitudinal advancement of the padlock body 19 into the tool box (e.g., to the left as viewed in FIG. 6)—whereby the padlock is locked—the padlock body engages an edge of the tang 40 and pivots the tang toward the shackle bight 22 (i.e., from the position shown in FIG. 6 to the position shown in FIG. 4). Thus, the shackle bight 22 engages the locking notch 41 of the tang 40 and, since the padlock is locked, prevents opening of the tool box.

The lock system may be unlocked by use of a key and either manual retraction of the padlock body 19 or retraction thereof by internal spring means associated with the padlock. Upon unlocking of the padlock, the tang returns to its normal inclined position (FIG. 6) with the locking notch 41 and shackle bight 22 disengaged. Accordingly, the tang may be lifted upwardly away from its position within the legs of the shackle 21, thereby allowing the tool box to be opened.

Figure 8:
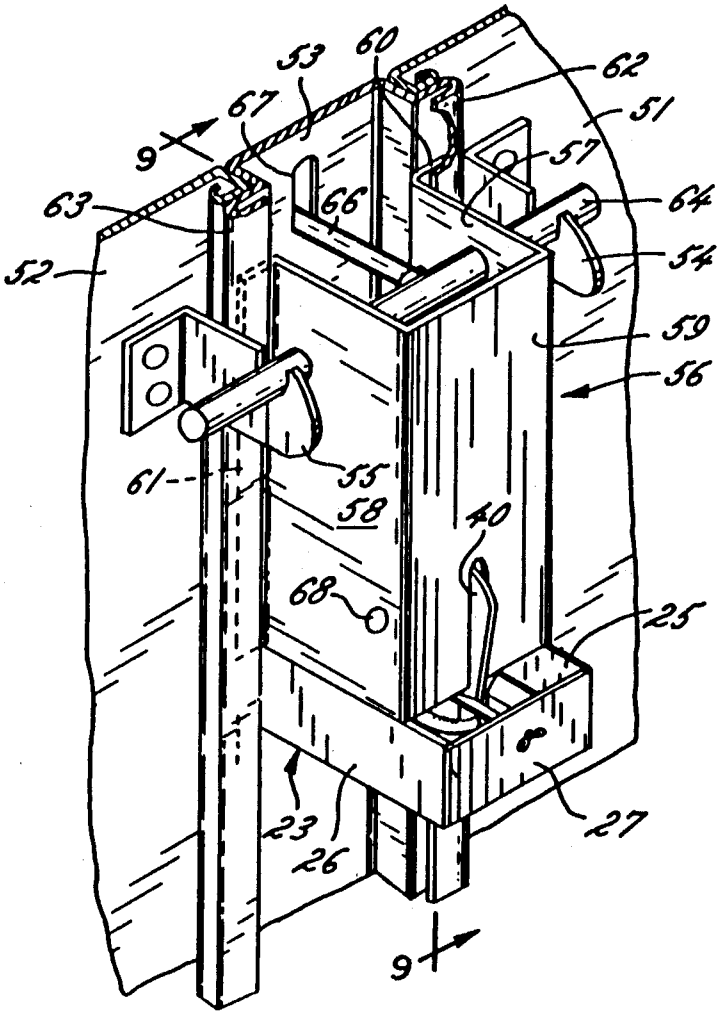
FIG. 8 is a fragmentary, perspective view of the storage cabinet of FIG. 7 on an enlarged scale and looking toward the inner face of a pair of cabinet doors.

The inventive lock system may also be used in association with a storage cabinet, as shown in FIGS. 7 and 8. A typical storage cabinet, indicated generally at 50, has a pair of doors 51, 52 with a central stile 53 therebetween formed integrally with the cabinet structure. The doors have inwardly-extending, notched catch members 54, 55 secured thereto, respectively.

In accordance with the present invention, a slide member 56 is provided which includes a pair of spaced-apart side panels 57, 58 interconnected by another panel 59. This slide member 56 may be moved vertically relative to the central stile 53 since it has out-turned flanges 60, 61 which slidably engage a corresponding pair of U-shaped channels 62, 63 formed on the inner side of the central stile 53. The slide member further comprises a transversely extending bar 64 which is secured thereto (e.g., by welding) and extends beyond the side panels 57, 58 for coaction with the notched catch members 54, 55 on the doors. A handle 65 is provided at the front of the central stile 53 and has a rod 66 which extends through a vertical slot 67 in the central stile and rigidly engages the bar 64 of the slide member, thereby enabling manual vertical movement of the slide member between lowered and raised (shown in phantom in FIG. 9) positions. In the lowered position, the bar 64 engages the catch members 54, 55 to maintain the doors 51, 52 in the closed position. When lifted to the raised (phantom) position of FIG. 9, the bar 64 disengages the catch members 54, 55 and the doors are free to open.

In the cabinet (FIGS. 7–9), the open end of a horizontal supporting shelf member 23 communicates with a front aperture 28 in the central stile 53 and is secured by welding edges of its bottom 24 and side walls 25, 26 thereto. This shelf supports a padlock such that the key insertion end 20 of the padlock body is exposed for external access through the aperture 28. Moreover, as in the tool box embodiment of FIGS. 1–6, the supporting shelf carries a bracket 29 having a pair of depending legs 30, 31 with coaxial openings 32, 33 therethrough. Accordingly, as described above, the padlock shackle 21 is held in the openings 32, 33 of the bracket and prevented from substantially moving.

In the cabinet arrangement, a rod 68 extends between the side panels 57, 58 of the slide member 56, and a tang 40 is connected thereto for pivotal movement with respect to the slide member.

It will be appreciated, therefore, that the tang 40 is associated with the movable doors 51, 52 of the cabinet, albeit indirectly, in contrast with the direct attachment of the tang 40 to the vertically-movable cover 12 in the tool box configuration. Of course, this indirect association is necessary in the cabinet since the cabinet doors 51, 52 move horizontally while the tang 40 moves vertically with respect to the captured padlock shackle 21.

Figure 9:
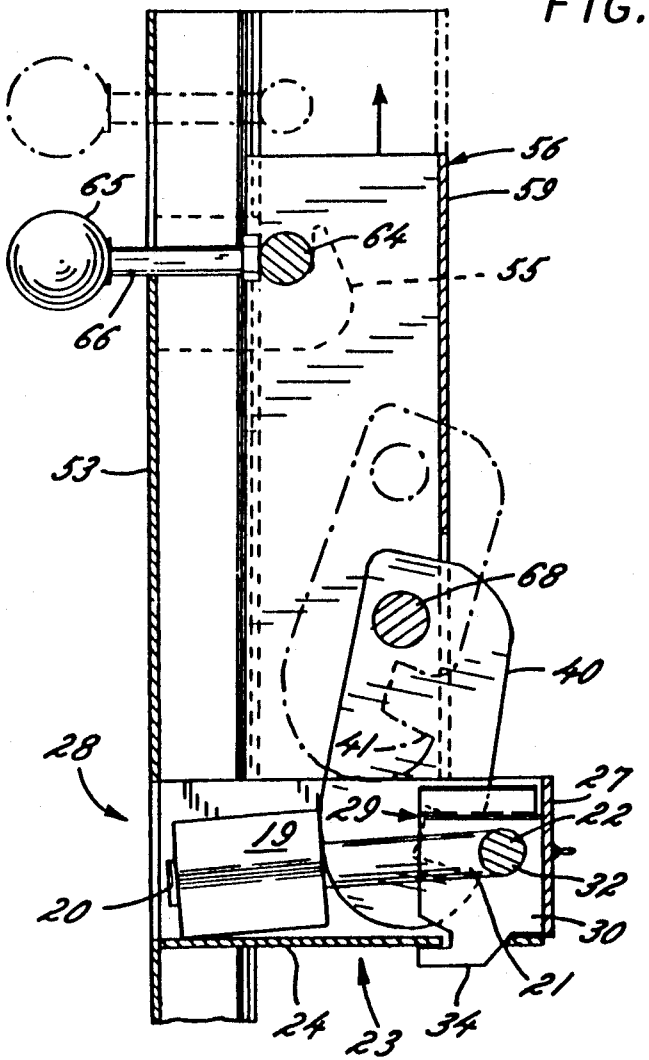
FIG. 9 is a vertical section, on a further enlarged scale, taken generally along the line 9—9 in FIG. 8 and showing the lock system unlocked and in a different operative position in broken line.

As in the tool box lock system, the orientation of the rod 68 with respect to the depending tang 40 urges the tang to a normally inclined position, as shown in FIG. 9. Thus, when the slide member 56 is in its lowered position, the tang 40 is positioned such that its lower end is loosely disposed within the legs of the shackle 21 with its locking notch 41 generally at the level of the shackle bight 22. As described for the tool box configuration, locking of the padlock causes engagement of the locking notch 41 and the shackle bight 22, thereby preventing vertically upward movement of the slide member 56 (and thus, the horizontal bar 64) and opening of the doors 51, 52. In contrast, when the padlock is unlocked, the tang 40 assumes its normal inclined position (FIG. 9) so that the slide member 56 can be raised and the doors can be opened. In other words, the action of the lock system in moving between locked and unlocked positions is substantially the same as that described in the tool box configuration.

Figure 10:
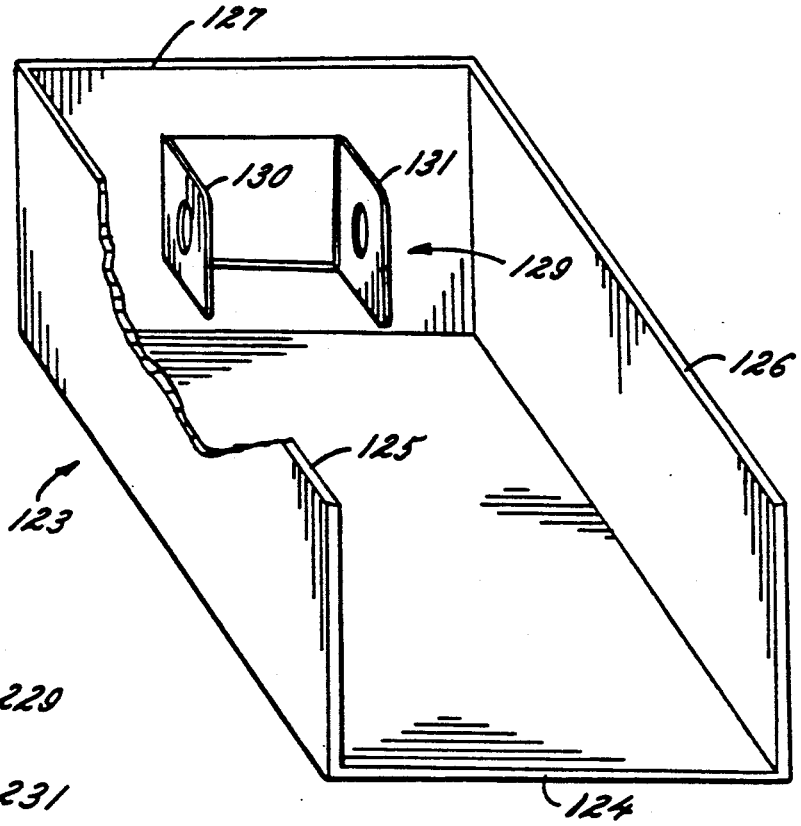
FIG. 10 is a perspective view, with parts broken away, of a second embodiment of the supporting shelf/-bracket arrangement of the present invention.

It will be appreciated that in accordance with this invention the bracket which holds the padlock shackle may take any of a number of configurations and/or may be carried by the supporting shelf by different means. For example, FIG. 10 shows an embodiment in which the bracket 129 comprises a pair of legs 130, 131 which are integral members of the supporting shelf 123. More specifically, in this embodiment the bracket 129 is made by first forming or cutting the vertical end wall 127 of the supporting shelf 123 to define the legs 130, 131 and then bending each of the legs into the interior channel of the supporting shelf so that they are substantially perpendicular to the end wall 127 and parallel to one another. Of course, it will be understood that slightly modified versions (not shown) of this embodiment can be made by forming the substantially parallel bracket legs 130, 131 in, and bending them out from, either the bottom 124 or side walls 125, 126 of the supporting shelf 123.

Figure 11:
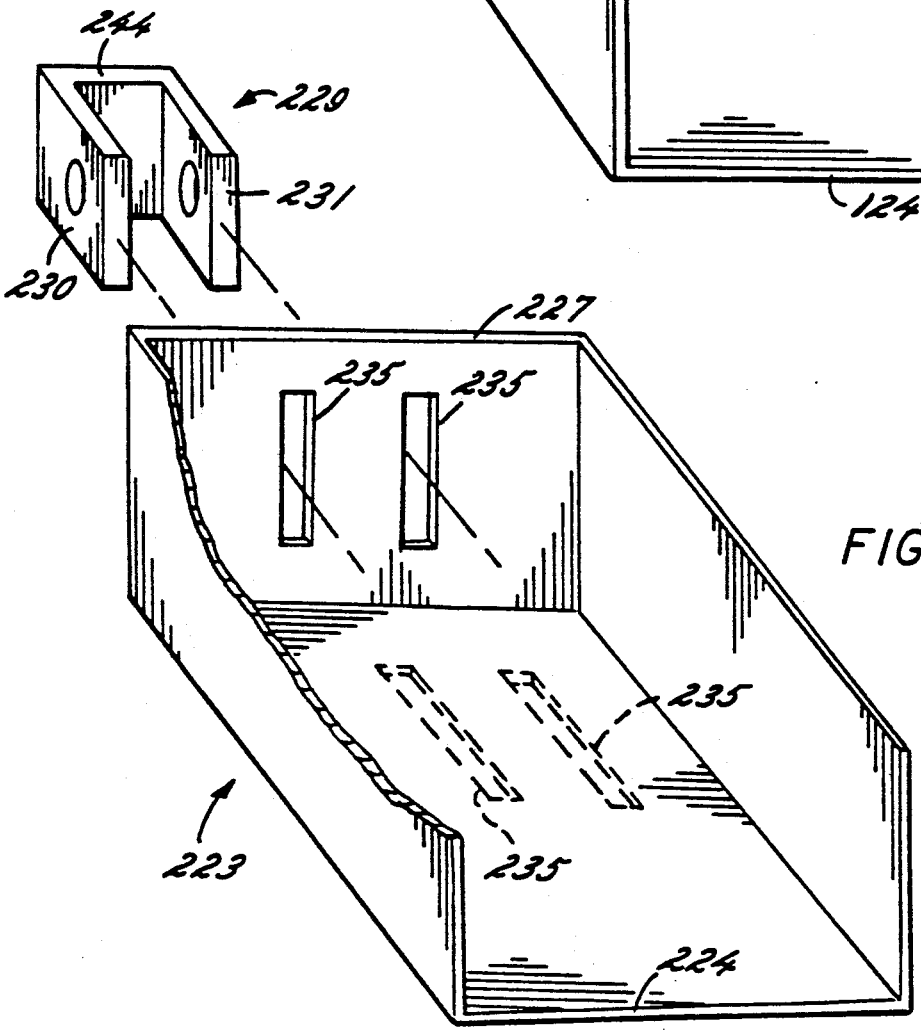
FIG. 11 is an exploded perspective view, with parts broken away and in phantom, of a third embodiment of the supporting shelf/bracket arrangement of the present invention.

In yet another embodiment (FIG. 11), the bracket 229 comprises a separate, substantially U-shaped member having a pair of legs 230, 231 and an interconnecting portion 244. This bracket 229 is formed such that the legs 230, 231 correspond with a pair of parallel slots 235 formed in the end wall 227 (or alternatively, bottom 224—shown in phantom) of the supporting shelf 223. Thus, the legs 230, 231 extend through the slots 235 and into the interior channel of the supporting shelf 223, wherein they engage the shackle of a padlock. If desired, the bracket 229 may be rigidly secured to the supporting shelf by any appropriate fastening means (e.g., screws, rivets, etc.).

In any of the bracket embodiments, the bracket may be formed to include an inclined flange along the upper edge of one or more of the legs. For example, as shown in FIG. 5, each bracket leg 30, 31 has an integral inclined flange 45 extending from its upper edge, opposite the supporting shelf 23. These inclined flanges 45 serve as guides for the tang 40 associated with the movable cover 12. Thus, if the cover is rapidly closed, the flanges 45 prevent the tang 40 from directly meeting the top edge of either bracket leg 30, 31 (which could damage either the bracket 29 or the tang 40) and, rather, guide the tang into its appropriate position between the legs 30, 31 of the bracket 29 and within the legs of the shackle 21.

As can be seen from the foregoing detailed description, the present invention provides an improved padlock-protecting lock system which may be quickly and easily installed and comprises a minimal number of elements, and thus is economical to manufacture.

What is claimed is:

1. A lock system for a container with a closure which is movable between open and closed positions, said lock system utilizing a padlock having a body with a key insertion end and a shackle, said lock system comprising:

means for supporting the padlock within the container such that the key insertion end of the padlock body is exposed for external access through an aperture in the container;

a unitary bracket removably connected to the supporting means for capturing the shackle of the padlock, the bracket having non-threaded prong means, which prong means themselves engage the supporting means; and a tang coupled to the movable closure which is positionable within the shackle for capture by the padlock upon locking thereof, whereby the closure is maintained in its closed position, the tang being positionable within the shackle such that the shackle need not be removed from the bracket to enable release of the tang.

2. The lock system of claim 1 wherein the supporting means within the container comprises a substantially horizontal shelf member which is attached to the interior of the container and communicates with the aperture.

3. The lock system of claim 1 wherein the supporting means has at least one slot formed therein to correspond with the prong means of the bracket, whereby the bracket is removably connected to the supporting means by insertion of each prong means into a corresponding slot.

4. The lock system of claim 1 wherein the tang is pivotally mounted on the movable closure and has a locking notch for engagement with the shackle when the tang is in a substantially vertical position, the tang being normally urged to an inclined position with the locking notch out of engagement with the shackle whereby closing of the padlock causes the padlock body to advance the tang to cause the engagement.

5. The lock system of claim 1 wherein the bracket comprises a substantially U-shaped member having a pair of depending legs which have coaxial openings therethrough for capturing the shackle of the padlock.

6. The lock system of claim 5 wherein at least one of the legs has an integral inclined flange which extends away from the supporting means for guiding the tang within the shackle upon closing of the closure.

7. The lock system of claim 1 wherein the container comprises a cabinet having at least one movable door with an inwardly extending catch member, said cabinet further comprising a movable member engageable with the catch member to hold the door closed, a slide member movably mounted on the interior of the cabinet and carrying the movable member and means operable from outside the cabinet for moving the slide member, the tang being connected to the slide member.

8. The lock system of claim 7 wherein the tang is pivotally mounted on the slide member and has a locking notch for engagement with the shackle when the tang is in a substantially vertical position, the tang being normally urged to an inclined position with the locking notch out of engagement with the shackle whereby closing of the padlock causes the padlock body to advance the tang to cause the engagement.

9. The lock system of claim 7 wherein the supporting means within the container comprises a substantially horizontal shelf member which is attached to the interior of the container and communicates with the aperture.

10. The lock system of claim 7 wherein the supporting means has at least one slot formed therein to correspond with the prong means of the bracket, whereby the bracket is removably connected to the supporting means by insertion of each prong means into a corresponding slot.

11. The lock system of claim 7 wherein the bracket comprises a substantially U-shaped member having a pair of depending legs which have coaxial openings therethrough for capturing the shackle of the padlock.

12. The lock system of claim 11 wherein at least one of the legs has an integral inclined flange which extends away from the supporting means for guiding the tang within the shackle upon closing of the closure.

13. A lock system for a container with a closure which is movable between open and closed positions, said lock system utilizing a padlock having a body with a key insertion end and a shackle, said lock system comprising:

means for supporting the padlock within the container such that the key insertion end of the padlock body is exposed for external access through an aperture in the container;

a bracket carried by the supporting means and having a pair of depending legs which have coaxial openings therethrough for capturing the shackle of the padlock; and a tang coupled to the movable closure which is positionable within the shackle for capture by the padlock upon locking thereof, whereby the closure is maintained in its closed position, the tang being positionable within the shackle such that the shackle need not be removed from the bracket to enable release of the tang.

14. The lock system of claim 13 wherein the supporting means within the container comprises a substantially horizontal shelf member which is attached to the interior of the container and communicates with the aperture.

15. The lock system of claim 13 wherein the tang is pivotally mounted on the movable closure and has a locking notch for engagement with the shackle when the tang is in a substantially vertical position, the tang being normally urged to an inclined position with the locking notch out of engagement with the shackle whereby closing of the padlock causes the padlock body to advance the tang to cause the engagement.

16. The lock system of claim 13 wherein at least one of the legs has an integral inclined flange which extends away from the supporting means for guiding the tang within the shackle upon closing of the closure.

17. The lock system of claim 13 wherein the bracket has integral prong means for removably engaging the supporting means.

18. The lock system of claim 17 wherein the bracket is substantially U-shaped.

19. The lock system of claim 17 wherein the supporting means has at least one slot formed therein to correspond with the prong means of the bracket, whereby the bracket is removably connected to the supporting means by insertion of each prong means into a corresponding slot.

20. The lock system of claim 17 wherein the tang is pivotally mounted on the movable closure and has a locking notch for engagement with the shackle when the tang is in a substantially vertical position, the tang being normally urged to an inclined position with the locking notch out of engagement with the shackle whereby closing of the padlock causes the padlock body to advance the tang to cause the engagement.

21. The lock system of claim 17 wherein at least one of the legs has an integral inclined flange which extends away from the supporting means for guiding the tang within the shackle upon closing of the closure.

22. The lock system of claim 17 wherein the container comprises a cabinet having at least one movable door with an inwardly extending catch member, said cabinet further comprising a movable member engageable with the catch member to hold the door closed, a slide member movably mounted on the interior of the cabinet and carrying the movable member and means operable from outside the cabinet for moving the slide member, the tang being connected to the slide member.

23. The lock system of claim 13 wherein the bracket comprises an integral member of the supporting means.

24. The lock system of claim 23 wherein the tang is pivotally mounted on the movable closure and has a locking notch for engagement with the shackle when the tang is in a substantially vertical position, the tang being normally urged to an inclined position with the locking notch out of engagement with the shackle whereby closing of the padlock causes the padlock body to advance the tang to cause the engagement.

25. The lock system of claim 23 wherein at least one of the legs has an integral inclined flange which extends away from the supporting means for guiding the tang within the shackle upon closing of the closure.

26. The lock system of claim 23 wherein the container comprises a cabinet having at least one movable door with an inwardly extending catch member, said cabinet further comprising a movable member engageable with the catch member to hold the door closed, a slide member movably mounted on the interior of the cabinet and carrying the movable member and means operable from outside the cabinet for moving the slide member, the tang being connected to the slide member.

* * * * *